US007150324B2

(12) United States Patent
Laursen et al.

(10) Patent No.: US 7,150,324 B2
(45) Date of Patent: Dec. 19, 2006

(54) METHOD AND APPARATUS FOR RISERLESS DRILLING

(75) Inventors: Patrick Emmett Laursen, Sugar Land, TX (US); John Christian Hartley Mungall, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/264,549

(22) Filed: Oct. 4, 2002

(65) Prior Publication Data

US 2004/0065475 A1 Apr. 8, 2004

(51) Int. Cl.
*E21B 29/12* (2006.01)

(52) U.S. Cl. ..... 166/355; 166/358; 166/368; 405/224

(58) Field of Classification Search ..... 166/341, 166/344, 345, 346, 352, 355, 358, 368; 405/224; 175/5, 6

See application file for complete search history.

(56) References Cited

U.S. PATENT DOCUMENTS 3,032,125 A * 5/1962 Hiser et al. ..... 175/7
3,047,078 A * 7/1962 Postlewaite ..... 175/7
3,114,420 A * 12/1963 Wilde ..... 166/354
3,129,774 A * 4/1964 Armstrong ..... 166/354
3,142,343 A * 7/1964 Otteman et al. ..... 175/7
3,142,344 A * 7/1964 Otteman et al. ..... 175/7
3,191,696 A * 6/1965 Pollard et al. ..... 175/7
3,236,308 A * 2/1966 Leake ..... 166/338
3,496,898 A * 2/1970 Morgan ..... 114/294
3,516,488 A * 6/1970 Joubert et al. ..... 166/359
3,528,497 A 9/1970 Lehman
3,618,679 A * 11/1971 Crooke ..... 175/135
4,053,022 A * 10/1977 Mercier ..... 175/5
4,121,806 A * 10/1978 Iato et al. ..... 166/355
4,240,506 A * 12/1980 Dareing ..... 166/367
4,320,993 A * 3/1982 Hunter ..... 405/224
4,391,554 A * 7/1983 Jones ..... 405/224
4,516,882 A * 5/1985 Brewer et al. ..... 405/224
4,643,614 A * 2/1987 Laursen ..... 405/169
4,818,147 A * 4/1989 Rasmussen ..... 405/224
4,854,781 A * 8/1989 Sparks et al. ..... 405/224.4

(Continued)

OTHER PUBLICATIONS

[online]. Retrieved from the Internet on Jan. 15, 2003: <URL: http://www.mcs-international.com/resources/pub-bottom.html O'Regan, T.L., et al.; *Bend Restrictors for Flexible Risers*; Proceedings of Offshore Mechanics and Arctic Engineering Conference, Lisbon, Portugal, 1998; (pp. 8).

(Continued)

*Primary Examiner*—Thomas A Beach
(74) *Attorney, Agent, or Firm*—Conley Rose, P.C

(57) ABSTRACT

An offshore riserless drilling system drills a subsea borehole from a platform and through a cased borehole. The system comprises a lightweight drill string suspending a bottomhole assembly and extending from the platform downwardly through a depth of water into the cased borehole; a first limiter limiting the range of motion of the drill string adjacent the platform; and a second limiter limiting the range of motion of the drill string adjacent the cased borehole. The preferred methods include lowering a bottomhole assembly suspended on a lightweight drill string from a platform through a depth of water; limiting the bend radius of the drill string adjacent the platform; guiding the bottomhole assembly into a cased borehole; limiting the bend radius of the drill string adjacent the cased borehole; maintaining the bottomhole assembly in the cased borehole, and drilling the subsea borehole.

21 Claims, 9 Drawing Sheets

U.S. PATENT DOCUMENTS

| | | | | |
|---|---|---|---|---|
| 5,722,492 | A * | 3/1998 | Finn | 166/367 |
| 5,971,075 | A * | 10/1999 | Odru et al. | 166/350 |
| 6,003,606 | A | 12/1999 | Moore et al. | 166/381 |
| 6,116,345 | A * | 9/2000 | Fontana et al. | 166/343 |
| 6,296,066 | B1 | 10/2001 | Terry et al. | 175/92 |
| 6,352,116 | B1 | 3/2002 | Birseth | |
| 6,386,290 | B1 * | 5/2002 | Headworth | 166/346 |
| 6,386,798 | B1 * | 5/2002 | Finn | 405/224.2 |
| 6,408,948 | B1 * | 6/2002 | Fontana et al. | 166/341 |
| 6,431,284 | B1 | 8/2002 | Finn et al. | 166/350 |
| 6,612,369 | B1 * | 9/2003 | Rocha et al. | 166/363 |

OTHER PUBLICATIONS

[online]. Retrieved from the Internet on Jan. 15, 2003: <URL: http://www.2hoffshore.com/papers/papers_1996.htm: S. Hatton, et al; *Rigid Risers for Economic Well Intervention*; DEEPTEC 96, Aberdeen, Jan. 1996; (pp. 18).

[online]. Retrieved from the Internet on Jan. 15, 2003: <URL: http://www.demo2000.net/e_prosjekter.html *RICTIS—Riserless Coiled Tubing Intervention System*; ABB Offshore Systems, Stavanger, Norway; (pp. 2).

Dril-Quip Brochure *QMFC Marine Drilling Riser Systems*; Dril-Quip, Inc.; 1998; (pp. 8.).

Specification for Unbonded Flexible Pipe, API Specification 17J, Section 3 Definitions and Abbreviations pp. 3-5 and Appendix B pp. 43-45; American Petroleum Institute; Dec. 2002; (pp. 7).

Recommended Practice for Flexible Pipe, API Recommended Practice 17B, Section 4.4 Ancillary Components pp. 18-25 and Section 7.5 Ancillary Components pp. 38-60; American Petroleum Institute; Third Edition, Mar. 2002 (pp. 12).

PCT International Search Report for Appln. No. PCDT/US03/20751 dated Nov. 19, 2004; (3 p.).

* cited by examiner 100
120
126
135
124
122
128
190
110
115
140
185
180
150
170

128
110
210
135
115
220
145

128
110
210
135
115
330
334
332
145

128
110
210
135
115
330
145

METHOD AND APPARATUS FOR RISERLESS DRILLING

CROSS-REFERENCE TO RELATED APPLICATIONS

The present application is related to application Ser. No. 10/265,028, filed Oct. 4, 2002 and entitled Methods and Apparatus for Open Hole Drilling, hereby incorporated herein by reference in its entirety.

STATEMENT REGARDING FEDERALLY SPONSORED RESEARCH OR DEVELOPMENT

Not Applicable.

BACKGROUND OF THE INVENTION

1. Field of the Invention

The present invention relates generally to methods and apparatus for performing riserless drilling from an offshore platform, and more particularly, to methods and apparatus for performing riserless drilling using a lightweight drill string, and still more particularly, to methods and apparatus for drilling an offshore well from a platform using a lightweight, small diameter, continuous drill string thereby enabling the use of comparatively smaller diameter pipe components and a smaller platform versus conventional methods.

2. Description of the Related Art

Offshore hydrocarbon drilling and producing operations are typically conducted from a drilling rig located either on a bottom-founded offshore platform or on a floating platform. A bottom-founded platform extends from the seafloor upwardly to a deck located above the surface of the water, and at least a portion of the weight of the platform is supported by the seafloor. In contrast, a floating platform is a ship, vessel, or other structure, such as a tension-leg platform, for example, in which the weight of the platform is supported by water buoyancy.

In recent years, exploration and production of offshore crude oil and natural gas reservoirs has expanded into ever-deeper waters. Successful drilling operations have been conducted in deep waters of at least 3,000 feet deep, and ultra-deep waters ranging from 5,500 to 10,000 feet deep. With increasing water depths, drilling operations conducted from moored or dynamically positioned floating platforms have become more prevalent since economic and engineering considerations militate against the use of bottom-founded drilling platforms commonly used in shallow water.

Regardless of whether a bottom-founded or floating platform is used, conventional methods for drilling an offshore well are similar. In such operations, the platform supports a drilling rig and associated equipment, and must include adequate deck space for pipe storage and handling. The platform is positioned near the wellsite, and a drill string, typically formed of jointed steel pipe that is threaded together one joint at a time, conveys a bottom-hole drilling assembly (BHA) from the platform to the seafloor. A drill bit, disposed at the terminal end of the BHA, drills the well.

Riserless Drilling

When drilling from a floating platform, the upper portion of the well is drilled by riserless drilling in that no conduit is provided for the returns to flow to the platform. Therefore, in riserless drilling the returns, i.e. the drilling fluid, cuttings, and well fluids, are discharged onto the seafloor and are not conveyed to the surface. To drill the initial upper portion of the well, the drill string typically extends unsupported through the water to the seafloor without a riser. In more detail, first an outer casing, known as "structural casing", typically having a diameter of 30-inches to 36-inches, is installed in the uppermost section of the well, with a low-pressure wellhead housing connected thereto. In soft formations, the structural casing is typically jetted into place. In this process, an assembly is lowered to the seafloor on a conventional drill string. The assembly includes the structural casing, and typically, a BHA with drill collars, a downhole motor, and a drill bit. The bit is positioned just below the bottom end of the structural casing, and is sized to drill a borehole with a slightly smaller diameter than the diameter of the casing. As the borehole is drilled, the structural casing moves downwardly with the BHA. The weight of the structural casing and BHA drives the casing into the sediments. The structural casing, in its final position, generally extends downwardly to a depth of 150 to 400 feet, depending upon the formation conditions and the final well design. After the structural casing is in place, it is released from the drill string and BHA. The drill string and BHA are then tripped back to the platform, or are, in some cases, lowered to drill below the structural casing.

In more competent formations, the structural casing is similar, but it is installed in a two-step process. First, a borehole larger than the structural casing is drilled. Then the structural casing is run into the borehole and cemented into place. Typically, the low-pressure wellhead housing is connected to the upper end of the structural casing and installed at the same time, such that the structural casing extends below the seafloor with the low-pressure wellhead housing above the seafloor.

Once the structural casing and the low-pressure wellhead housing are installed, the BHA on the drill string drills downwardly below the structural casing to drill a new borehole section using riserless drilling for an intermediate casing, known as "conductor casing," which is typically 20-inches in diameter. Thus, the structural casing guides the BHA as it begins to drill the conductor casing interval. During riserless drilling, returns of the drilling fluid and cuttings are discharged onto the seafloor.

After the borehole section for the conductor casing is drilled, the BHA is tripped to the surface. Then conductor casing, with a high-pressure wellhead housing connected to its upper end, and a float valve disposed in its lower end, is run into the drilled conductor borehole section extending below the structural casing. The conductor casing is cemented into place in a well known manner, with the float valve preventing cement from flowing upwardly into the conductor casing after cement placement. The conductor casing generally extends downwardly to a depth of 1,000 to 3,000 feet below the seafloor, depending on the formation conditions and the final well design. The high-pressure wellhead housing engages the low-pressure wellhead housing to form the subsea wellhead, thereby completing the riserless portion of the drilling operations. A subsea blowout preventer (BOP) stack is typically conveyed down to the seafloor by a riser and latched onto the subsea wellhead housing. The riser is thereby installed with its lower end connected to the subsea wellhead via the BOP stack and the riser extending to the platform at the surface. Subsequent casing strings are hung, and well operations are conducted through the subsea wellhead.

Riserless drilling, as described above for drilling the conductor casing borehole, is conventionally performed using a drill string formed of steel pipe joints having a size and weight sufficient to withstand the lateral forces imposed by water currents. However, this conventional method of riserless drilling has a number of disadvantages, especially when drilling from a floating platform in deep or ultra-deep waters.

Drilling with a Riser

Once the well reaches a certain depth, further drilling requires the use of a weighted drilling fluid to maintain control of downhole pressures, and such drilling fluids are costly enough to warrant returning the drilling fluid to the platform for cleaning so that the same drilling fluid may be recirculated for further drilling. Thus, after the riserless drilling portion of the well has been drilled and cased, a low-pressure riser, formed by joining sections of casing or pipe that is typically 21-inches in diameter, is deployed between the floating platform and the wellhead equipment. The riser is provided to guide the drill string to the wellhead equipment for conducting further well drilling operations, and to provide a conduit for returning drilling fluid from the well to the floating platform.

Once the riser is in place, the drill string and BHA are lowered through the riser, the subsea wellhead, and the conductor casing to drill through the float valve into the seafloor to form another borehole section for another string of casing. The next casing, known as "surface casing," which is typically 13⅜ to 16 inches in diameter, is lowered into the drilled borehole and cemented into place via conventional procedures. The surface casing generally extends to a depth of 2,500 to 5,000 feet below the seafloor, depending on the formation characteristics and final well design. Subsequent, smaller diameter, intermediate casing strings may be installed below the surface casing.

This conventional method of drilling with a riser from a platform has a number of disadvantages, especially when drilling from a floating platform in deep or ultra-deep waters. First, the required size and capacity of the platform is largely based on the depth of water, and the corresponding amount of pipe required to drill the well. The larger the pipe, and the more pipe required to form the riser, the greater the weight and space requirements of the drilling rig and floating platform. To handle the weight of a large and long drill string, and a large and long riser, the floating platform must be equipped with a conventional drilling rig and must have significant deck space for storing and handling the large amount of pipe required for the drilling operation.

Thus, as water depth increases, larger floating platforms are required for larger drilling rigs to handle and support the added weight of the pipe due to the greater depth and to store the additional pipe, thereby significantly increasing the costs of drilling as water depth increases. Further, tripping into and out of the well with jointed pipe is very time-consuming since each joint of pipe must be threaded and/or unthreaded to the pipe string extending through the water and into the well.

Various improvements may be made to overcome the deficiencies of conventional drilling operations. It would be advantageous to reduce the size of the platform, particularly floating platforms required for deep water. One way to enable the use of a smaller platform would be to reduce the capacity requirement of the hoisting system, which would allow reduction of the drilling rig size, or would allow replacement of the drilling rig with a smaller capacity hoisting system. Further, the diameter and therefore the weight of the pipe, such as drill pipe, casing, and risers, could be reduced, thereby no longer requiring a large drilling rig to handle the pipe, and no longer requiring large storage space on the platform for the pipe. To achieve these objectives, it would be preferred to eliminate large risers and to use smaller risers. This will reduce the required drilling rig size and the amount of storage space required. When the riser diameter is reduced to the preferred smaller diameter, a conventionally sized drill string is too large to extend through the riser. For this reason, a smaller diameter drill string must be used when drilling through the preferred smaller diameter riser. A reduction in drill string diameter typically results in a proportional reduction in the weight of the drill string. Thus, in order to maximize efficiency, it would be preferable to use the same, smaller diameter, lighter drill string for conducting the riserless drilling operations described above. In addition to enabling the use of a smaller riser, the use of a smaller, lighter drill string is preferable because its lighter weight directly reduces the vessel size requirement.

For these reasons, it would be preferable to use a lighter weight drill string. It would be more preferable to use a non-jointed, continuous lighter weight drill string such as coiled tubing stored on a reel, thereby reducing the deck space required to store the drill string. Further, because a coiled tubing drill string is a continuous, single length of tubing that may be continuously fed from the reel into the water and down into the well, the time required to connect and disconnect the joints of a conventional drill string is eliminated, thereby significantly reducing the overall time required to conduct drilling operations. It would be still more preferable to use a non-metal coiled tubing drill string, such as the composite coiled tubing disclosed in U.S. Pat. No. 6,296,066 to Terry et al., hereby incorporated herein by reference for all purposes. Composite coiled tubing is preferable to metal pipe or metal coiled tubing because it weighs substantially less and is substantially less subject to fatigue-inducing stress variations due to trips into and out of the well and movement of the floating platform.

Drill string weight may be reduced by reducing the wall thickness of the drill string, or by altering the material that forms the drill string, such as by using a lightweight metal like titanium, or by using a lightweight composite material. A composite coiled tubing drill string may be formed of helically wound or braided fiber reinforced thermoplastic or fiber reinforced thermosetting polymer or epoxy, for example. It should be appreciated that one or more of these concepts may be combined to reduce drill string weight, resulting in a lightweight drill string. However, as the drill string is made lighter, it becomes more susceptible to the effects of water currents. The lighter the drill string, the more severe the effects. Because water currents vary with depth and with time, and because the variability of the currents increases with increasing water depth, it is difficult to precisely predict deepwater currents and thus to design for their adverse effects. In particular, water currents have various impacts on a lightweight drill string and BHA during riserless drilling. As used herein, a lightweight drill string is defined as a drill string, which is lighter than that used in conventional drilling, and which requires alternative systems and methods to conduct riserless drilling due to factors associated with its light weight, such as its response to water currents.

Conventional riserless drilling systems and methods cannot be used with a lightweight drill string due to the conventional systems' inability to counteract the effects of the water currents on the lightweight drillstring. Because the drill string is laterally constrained at the platform and at the point of entry into the borehole at the seafloor, the drill string will bow as the water currents impose lateral forces against it. As the weight of the drill string is reduced, it becomes less resistant to these undesirable effects of the water current, which can lead to unacceptably large bowing deflections and stresses in the drill string. As water depth increases, the bowing effect of the drill string increases because there is a greater length of the drill string upon which the water currents act. The bowing of the drill string exerts an upward force on the BHA, tending to pull the BHA out of the borehole. This upward force reduces weight-on-bit (WOB) and possibly lifts the bit off bottom, thereby preventing successful drilling.

Furthermore, as the weight of the drill strength is reduced and the water depth increases, the tendency of the drill string to kink increases, particularly at the floating platform and at the seafloor where the drill string is laterally constrained. Thus, if the drill string bends too sharply, it will kink, and ultimately fail. Therefore, to achieve successful riserless drilling with a lightweight drill string, a minimum bend radius must be maintained to prevent the drill string from ultimately failing. Devices used to restrict bending, such as conventional bend limiters, are commonly used to limit the range of motion of flexible risers to prevent overbending that could lead to kinking and failing. Thus, a bend limiter is any device that restricts bending of a tube and includes bellmouths and bend restrictors. A bellmouth is a flared, funnel-shaped device. The radius of curvature of the flare is designed based on the minimum allowable bend radius of a tube disposed through the bellmouth. A conventional bend restrictor is a mechanical device comprising a number of interlocking half-ring segments, each of which provides a mechanical stop to resist further bending once a minimum radius of curvature is reached. These bend limiter devices are further defined and described in the American Petroleum Institute (API), Specification 17J and Recommended Practice (RP) 17B, Sections 4.5 and 7.6, entitled "Ancillary Components."

Therefore, it would be advantageous to provide methods and apparatus to counteract the effects of water currents such that successful riserless drilling of the conductor casing borehole can be achieved using a lightweight drill string.

The present invention overcomes the deficiencies of the prior art.

SUMMARY OF THE INVENTION

The present invention features improved methods and apparatus for the riserless drilling of a subsea wellbore. The preferred embodiments comprise a system for riserless drilling of a subsea borehole from a platform and through a cased borehole, the system comprising a lightweight drill string suspending a bottomhole assembly and extending from the platform downwardly through a depth of water into the cased borehole; a first limiter limiting the range of motion of the drill string adjacent the platform; and a second limiter limiting the range of motion of the drill string adjacent the cased borehole. In one embodiment, the bottomhole assembly includes a tension/compression sensor, and the system includes an injector that adjusts tension in the drill string in response to measurements made by the tension/compression sensor.

The preferred embodiments further comprise a method of drilling a subsea borehole from a platform and through a cased borehole, the method comprising lowering a bottomhole assembly suspended on a lightweight drill string from the platform through a depth of water; limiting the bend radius of the drill string adjacent the platform; guiding the bottomhole assembly into the cased borehole; limiting the bend radius of the drill string adjacent the cased borehole; maintaining the bottomhole assembly in the cased borehole; and drilling the subsea borehole. In one embodiment, the method further comprises measuring tension in the drill string; and adjusting the tension in the drill string at the platform in response to the measured tension. In another embodiment, the method further comprises measuring an entry angle of the drill string adjacent the cased borehole; and adjusting the position of the platform in response to the entry angle measurement. In another embodiment, the method further comprises adjusting the tension in the drill string in response to the entry angle measurement.

Thus, the preferred embodiments of the present invention comprise a combination of features and advantages that overcome various problems of prior methods and apparatus. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiments of the present invention, reference will now be made to the accompanying drawings, in which like elements have been given like numerals, wherein.

DETAILED DESCRIPTION OF THE PREFERRED EMBODIMENTS

Figure 1:
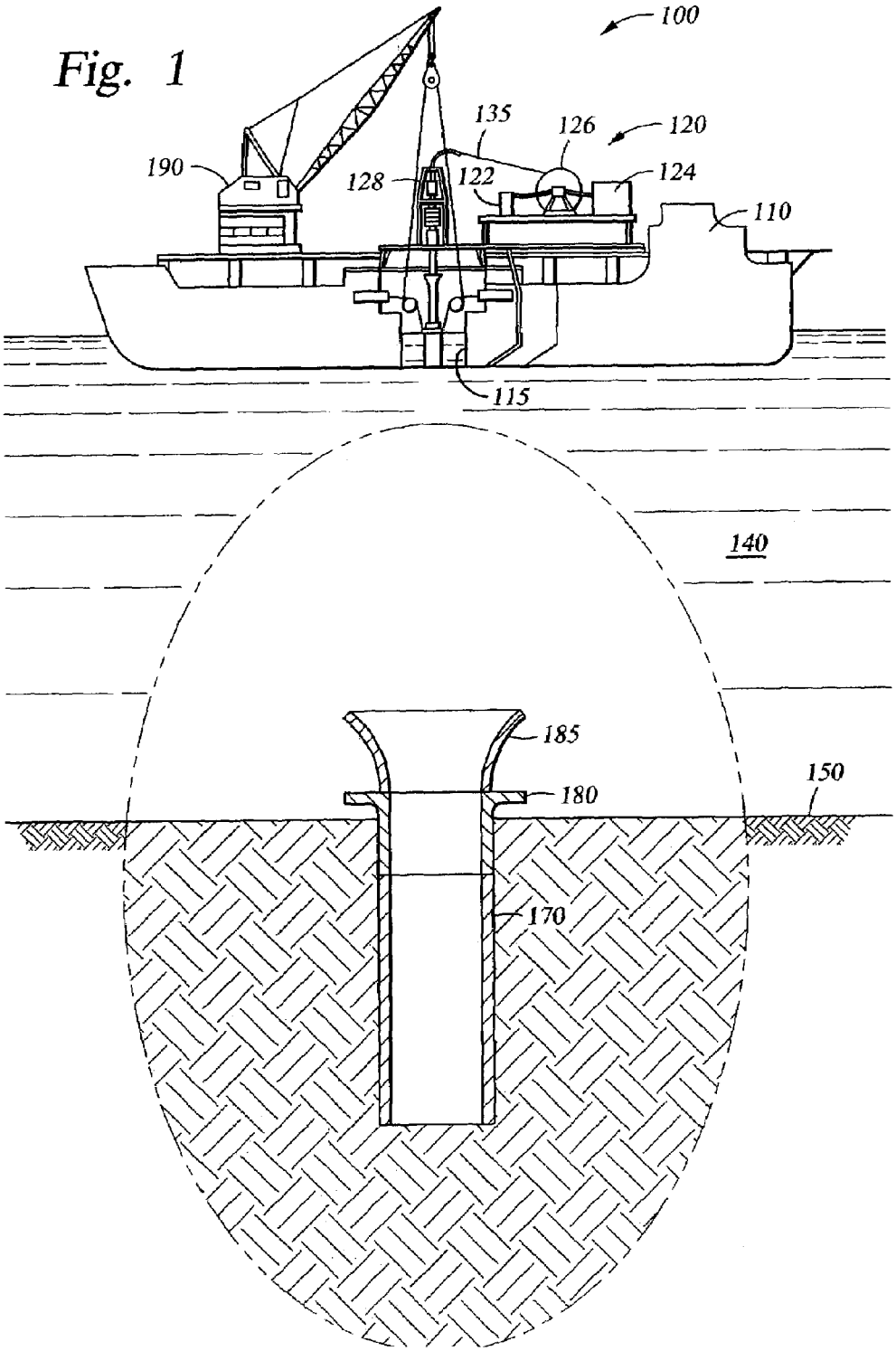
FIG. 1 is a schematic elevational view of one embodiment of an offshore drilling system comprising a floating vessel with a crane and a coiled tubing system situated over a subsea wellsite.

The present invention is susceptible to embodiments of different forms. There are shown in the drawings, and herein will be described in detail, specific embodiments of the present invention with the understanding that the present disclosure is to be considered only an exemplification of the principles of the invention, and is not intended to limit the invention to that illustrated and described.

The apparatus and methods of the present invention comprise offshore drilling from a platform using a lightweight drill string suspending a BHA. Various embodiments of the present invention provide a number of different configurations of the drill string, the BHA, the type of platform from which drilling operations occur (i.e. bottom-founded or floating), the depth of the water, and the sizes of pipe components, such as risers and casings. It should be appreciated that the embodiments of the present invention, therefore, provide a plurality of methods for offshore drilling from a platform. Thus, it is to be filly recognized that the different teachings of the embodiments discussed herein may be employed separately or in any suitable combination to produce desired results. In particular, the present system may be used in practically any type of offshore drilling operation utilizing a lightweight drill string.

Referring initially to FIG. 1, there is shown a schematic elevational view of one exemplary operating environment for the preferred embodiments of the present invention in a deepwater application. Although the present invention is applicable in any water depth, the deeper the water, the greater the advantages. A preferred embodiment of a drilling system 175, best shown in FIG. 2, includes a light weight drill string 135, such as metal or composite coiled tubing, and a bottom hole assembly 400 for drilling a borehole. An offshore platform 100 comprises a floating vessel 110 and a coiled tubing system 120 having a power supply 122, a surface processor 124, and a coiled tubing spool 126. An injector 128 advances the coiled tubing 135 from the spool 126 through the water 140 towards the seafloor 150, or retracts the coiled tubing 135 from the water 140 to be reeled back onto the spool 126, or holds the coiled tubing 135 stationary. Further, the injector 128 applies to the coiled tubing 135 the forces necessary for these operations. In preferred embodiments, the floating vessel 110 is not equipped with a conventional sized drilling rig because the weight of the required drilling equipment and pipe can be supported by a lower capacity hoisting system. Preferably, the required hoisting system on the floating platform 110 comprises a crane 190, or a smaller than conventional derrick (not shown), or a specially designed tower system (not shown).

In FIG. 1, the offshore floating platform 100 is shown situated adjacent a subsea wellsite 160 in which structural casing 170, a low-pressure wellhead housing 180, and a bellmouth 185 have previously been installed. Due to the preferably smaller diameter, light weight drill string 135, the structural casing 170 is preferably smaller in diameter than structural casing for conventional wells, and most preferably, the structural casing 170 has a diameter less than 30-inches to 36-inches, such as, for example, 7⅝-inches.

Figure 2:
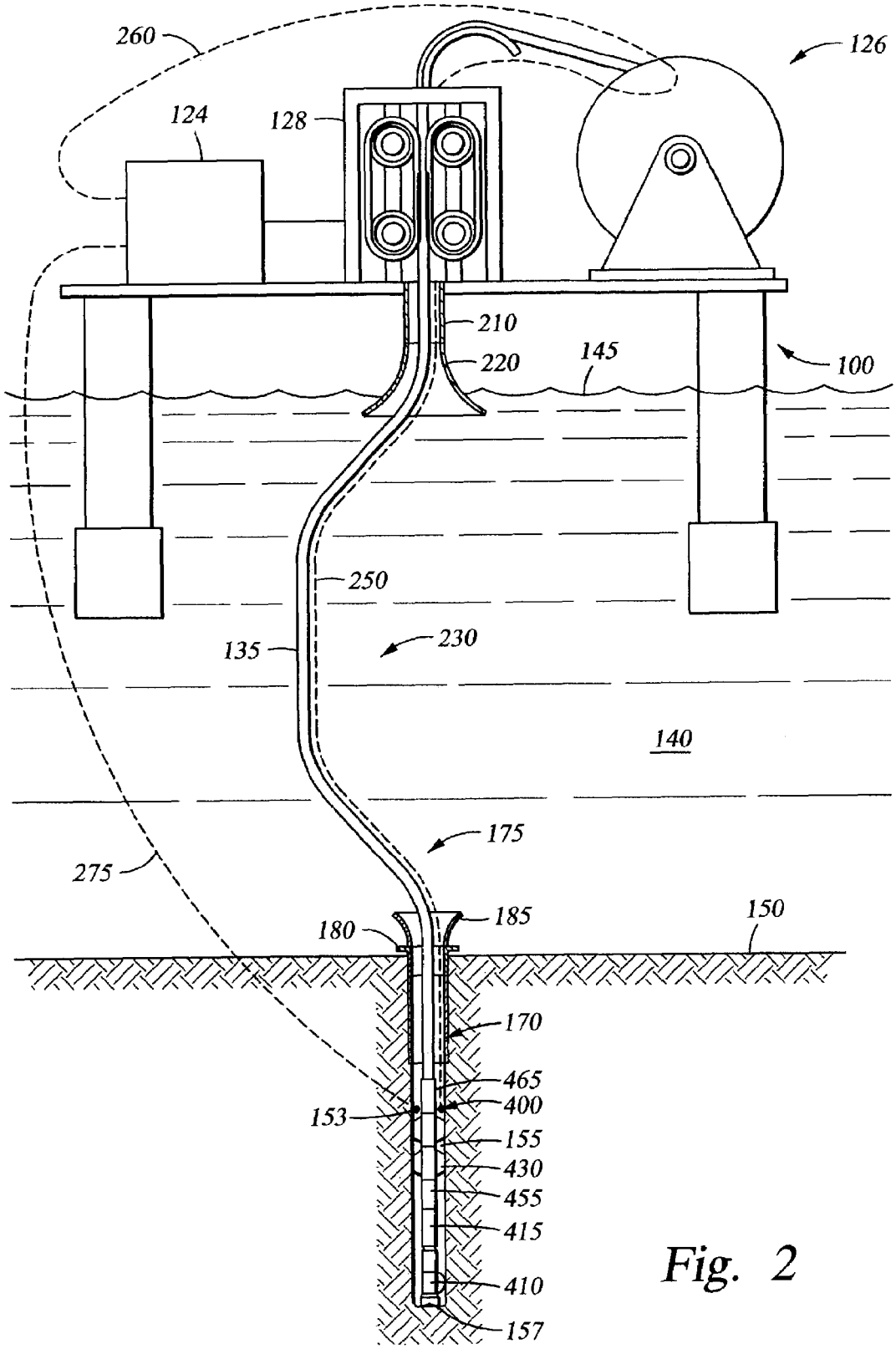
FIG. 2 is a schematic elevational view of the drilling system of FIG. 1 depicting a coiled tubing drill string extending from the floating vessel through the water to the seafloor, and a BHA disposed on the end of the drill string drilling a borehole for a conductor casing.

Referring now to FIG. 2, the preferred embodiments of the present invention comprise apparatus and methods for conducting riserless drilling with a lightweight drill string 135. According to conventional drilling methods, riserless drilling is performed to drill a borehole for conductor casing below the structural casing 170 using a heavy drill string with a BHA disposed on its lower end. Riserless drilling is successful when using conventional drill pipe because it is large and heavy enough to withstand the lateral forces imposed by water currents 230. In contrast, the preferred drilling system 175 of the present invention utilizes a drill string 135 formed of a lightweight tubing, such as coiled tubing. The lightweight drill string 135 may be formed of composite coiled tubing, or metal coiled tubing, or any lightweight tubing. If coiled tubing is used, composite is preferred over metal because of the desirable characteristics of composite, including: lighter weight, superior fatigue resistance, and the ability to contain data and power transmission conductors within the tubing wall. The lighter the weight of the drill string 135, however, the greater the effect of the water current 230 on the drill string 135. At some point, the drill string 135 becomes too light, such that the current 230 adversely impacts the drill string 135 and prevents successful conventional riserless drilling.

In one preferred embodiment, the coiled tubing 135 is formed of a composite material, such as the coiled tubing disclosed in U.S. Pat. No. 6,296,066 to Terry et al., hereby incorporated herein for all purposes, which is lighter than conventional drill pipe, and has an outer diameter (OD), such as for example 3⅛ inches, which is smaller than conventional drill pipe. By using the lighter weight, smaller diameter coiled tubing 135, which is stored on a spool 126, a smaller diameter and therefore lighter weight riser pipe can be used, which significantly reduces the load capacity requirements and space requirements for the platform 100. Accordingly, a smaller than conventional floating platform 100 can be utilized. When drilling the well, prior to drilling the deeper interval of the well using a drilling riser, a shallower interval is drilled riserless. By utilizing the same lightweight drill string 135 for the riserless interval as will be used in the subsequent interval drilled using a riser, the platform capacity requirements and space requirements can be further reduced, while also improving operational efficiency by minimizing drill string transfers and handling.

Drill string 135, preferably formed of composite coiled tubing, extends from the floating platform 100, through the water 140, and into the bellmouth 185 at the seafloor 150. The upper end of the drill string 135 passes through and is supported by a rigid extension 210 and a bend limiter, such as a bellmouth 220 or a bend restrictor (not shown), as it exits the injector 128 and extends through the moonpool 115 of the floating platform 100. A BHA 400 is disposed on the lower end of the drill string 135 to drill a borehole 155 below the structural casing 170 for the conductor casing.

Figure 3:
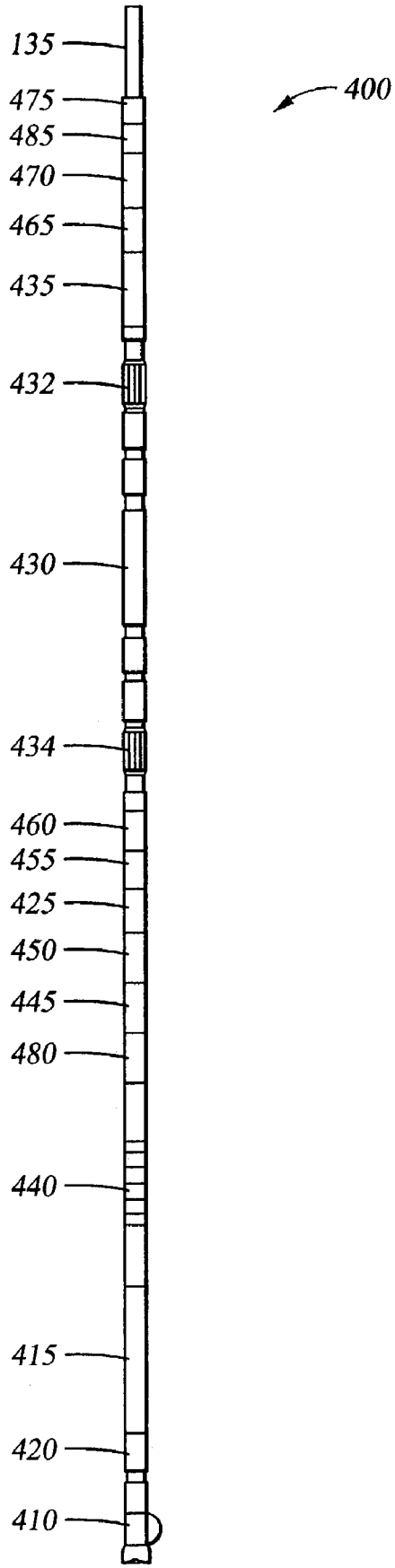
FIG. 3 is an enlarged view of the BHA of FIG. 2.

FIG. 3 provides, by way of example, an enlarged view of a preferred BHA 400 of FIG. 2. Preferably the BHA 400 is suspended on the end of the composite coiled tubing drill string 135 and a bit is disposed at the lowermost end of the BHA 400. In one embodiment, the bit may be a conventional drill bit. Alternatively, to perform slimhole drilling, the bit may be a bi-center bit 410 capable of passing through a smaller diameter structural casing 170 to drill a borehole 155 that is larger than the diameter of the conductor casing, thereby providing adequate annular space for cementing the conductor casing into place. Alternately, a conventional drill bit and underreamer combination, or a conventional drill bit and winged reamer combination, may be provided instead of a bi-center bit 410 to perform the same slimhole drilling function.

The BHA 400 preferably further comprises a downhole motor 415 for rotating the bi-center bit 410, upper and lower circulation subs 425, 435, a tractor 430 with borehole retention devices 432, 434, and upper and lower tension/compression subs 455, 465. One exemplary tractor 430 is described in U.S. Pat. No. 6,003,606, hereby incorporated herein by reference for all purposes. The BHA 400 may also include tools for steering the BHA 400, such as a three dimensional steering tool 420, and various detectors and sensors, such as, for example, a resistivity sensor 440, a gamma ray sensor 445, a directional sensor 450, a pressure/temperature sub 460, a casing collar locator 470, and/or a voltage-converter sub 475. The BHA 400 may further include various disconnects, such as an electrical disconnect 480 and a ball drop disconnect 485. Accordingly, FIG. 3 depicts one representative grouping of components that may comprise the BHA 400. However, one of ordinary skill in the art will readily appreciate that the BHA 400 may be configured to include a variety of different components, and may include additional or fewer components than those depicted in FIG. 3, depending on the well plan.

Referring again to FIG. 2, if no water currents 230 were acting on the drill string 135, and if the floating vessel 110 was stationary, then the drill string 135 would extend vertically downwardly from the floating vessel 110 in a straight line into the bellmouth 185. However, the water currents 230 impose lateral forces on the lightweight drill string 135, thereby causing the drill string 135 to be deflected horizontally in the direction of the water currents 230 as the drill string 135 extends from the floating vessel 110 towards the bellmouth 185. Therefore, the BHA 400 is preferably physically guided, such as by remotely operated vehicles (ROVs) 320 shown in FIG. 2A, through the water 140 to enter the bellmouth 185, thereby allowing for the floating vessel 110 to be positioned directly over the wellsite 160. Remote cameras may also be provided to help direct the BHA 400 into the bellmouth 185. Due to the water currents 230, if the BHA 400 is not physically guided through the water 140, the floating vessel 110 must be horizontally displaced from the wellsite 160 so that the drill string 135 extends at an angle through the water 140 to reach the bellmouth 185. Dynamic positioning devices enable accurate placement of the floating platform 100 that is horizontally offset from the wellsite 160. The objective is to locate the floating platform 100 to achieve the best performance by the drilling system 175.

For the case where the BHA 400 is just above the seafloor 150 at the wellsite 160 and is not physically guided through the water 140, the horizontal displacement of the floating vessel 110 from the wellsite 160, for a given current profile, is approximately inversely proportional to the weight of the drill string 135. For example, if the drill string 135 is formed of steel tubing that weighs approximately 24 pounds per foot and the vessel 110 must be horizontally displaced from the wellsite 160 by approximately 100 feet, then the horizontal displacement of the vessel 110 would be approximately 800 feet for a drill string 135 formed of composite coiled tubing that weighs approximately 3 pounds per foot.

Similarly, weight also affects the variation in tension on the drill string 135 as a result of the water currents 230. For example, if the tension in a drill string 135 formed of steel tubing varies from approximately 20 kips at the seafloor 150 to approximately 230 kips at the floating vessel 110 when the BHA 400 is just entering the bellmouth 185, then the tension in a composite coiled tubing drill string 135 under the same conditions would vary from approximately 5 kips to 18 kips. Thus, a composite coiled tubing drill string 135 has a relatively small tension variation from the seafloor 150 to the floating vessel 110 due to its comparatively lighter weight. This small tension variation is well within the capabilities of preferred embodiments of the present invention, which utilize a composite coiled tubing drill string 135 capable of withstanding a tension up to 40 kips, with a working tension of 30 kips.

The water currents 230 have various adverse impacts on the lightweight drill string 135 and BHA 400 during riserless drilling. First, as the water currents 230 impose lateral forces against the drill string 135 causing it to bow as shown in FIG. 2, an upward force is imposed on the BHA 400, tending to pull the BHA 400 out of the borehole. This upward force negatively impacts drilling progress because the weight-on-bit is reduced, and the bi-center bit 410 on the lower end of the BHA 400 may no longer remain on the bottom 157 of the borehole 155 being drilled. Further, the lightweight drill string 135 is inherently more susceptible to kinking at the floating vessel 110 and at the seafloor 150. In particular, there will be a tendency for the lightweight drill string 135 to kink below the coiled tubing injector 128 and at the point of entry at the seafloor 150. Additionally, as a result of the forces imposed by the water currents 230, the lightweight drill string 135 may experience vortex induced vibrations, which have the potential to damage the drill string 135. Each of these effects can be managed by maintaining the BHA 400 in the borehole 155 and ensuring that proper tension is maintained in the drill string 135.

In particular, to counteract the upward force on the BHA 400, the preferred embodiments of the present invention includes maintenance means for ensuring that the BHA 400 is maintained or anchored in the borehole 155. One preferred maintenance means is a tractor 430 that engages the borehole wall and advances the BHA 400 downwardly in the borehole 155. Another preferred means of maintaining the BHA 400 in the borehole 155 is to provide a BHA 400 with a predetermined weight such that the water currents 230 can not lift the BHA 400 out of the borehole 155. The weight must be adequate to result in tension in the drill string 135 while maintaining a suitably constant weight on bit. Either of these means would be utilized in combination with tension/compression sensor subs 455, 465 and the coiled tubing injector 128, as further described below.

With respect to drilling with a tractor 430, the borehole retention devices 432, 434 grippingly engage and maintain continuous contact with the borehole wall 153 to anchor the BHA 400. Once drilling has begun, it is desirable to keep the drill string 135 in tension between the tractor 430 and the injector 128 to prevent the drill string 135 from excessively bowing or drifting in the currents 230. The more tension on the drill string 135 (i.e. the tighter the drill string 135), the less quantity of drill string 135 is spooled out between the floating vessel 110 and the seafloor 150. Thus, greater tension provides less length of drill string 135 exposed to the water currents 230, thereby limiting drag. Further, greater tension limits bowing of the drill string 135, and limits the bend radius of the drill string 135 at the floating vessel 110 and at the seafloor 150. In addition, if vortex induced vibrations are experienced, the drill string tension may be increased or decreased in order to minimize the vibrations. Thus, it is desirable to maintain tension along the entire drill string 135, which is axially controlled at the floating vessel 110 via the injector 128 and at the seafloor 150 via the maintenance means on the BHA 400.

However, a compression force is required on the bi-center bit 410 to drill the borehole 155. The compression is generated by the force or thrust applied by the tractor 430. Thus, in operation, the lower tension/compression sensor 455 is used to optimize drilling by facilitating correction of the weight on bi-center bit 410, whereas the upper tension/compression sensor 465 is monitored for changes in tension on the drill string 135 imposed by variations in the water current 230. These sensors 455, 465 are preferably connected to conductors (not shown) disposed within the wall of the composite coiled tubing drill string 135 such that tension and compression data is sent real-time to the surface processor 124 via a signal 250, shown in dashed lines. Alternatively, a drill string 135 formed of lightweight metal tubing with an electric line extending through the flowbore of the metal tubing could be utilized. Other methods of transmitting data are via a mud pulse telemetry or electromagnetic telemetry signal 275, for example, shown in dashed lines. Thus, when a change in the water currents 230 causes a variation in the tension on the drill string 135, the tension/compression sensors 455, 465 will immediately sense the change and provide the tension/compression data to the surface processor 124, preferably via signal 250.

The tension of the drill string 135 is controlled at the floating vessel 110 by the tubing injector 128, which acts as a lifting/tension device. Other types of tension apparatus are also available as is well known in the art. Thus, the top of the drill string 135 may be moved up or down by the injector 128 or other tension apparatus to maintain a suitable level of tension on the drill string 135 as conditions change. Preferably, the coiled tubing injector 128 is automatically controlled by a signal 260 from the surface processor 124 that responds to the tension/compression data signals 250 or 275. Alternatively, the data can be used by an operator to control the level of tension in the drill string 135. Thus, regardless of the telemetry method, the speed of data transmission must be fast enough to enable compensation in the tension of the drill string 135 so that drilling progresses.

Figure 4:
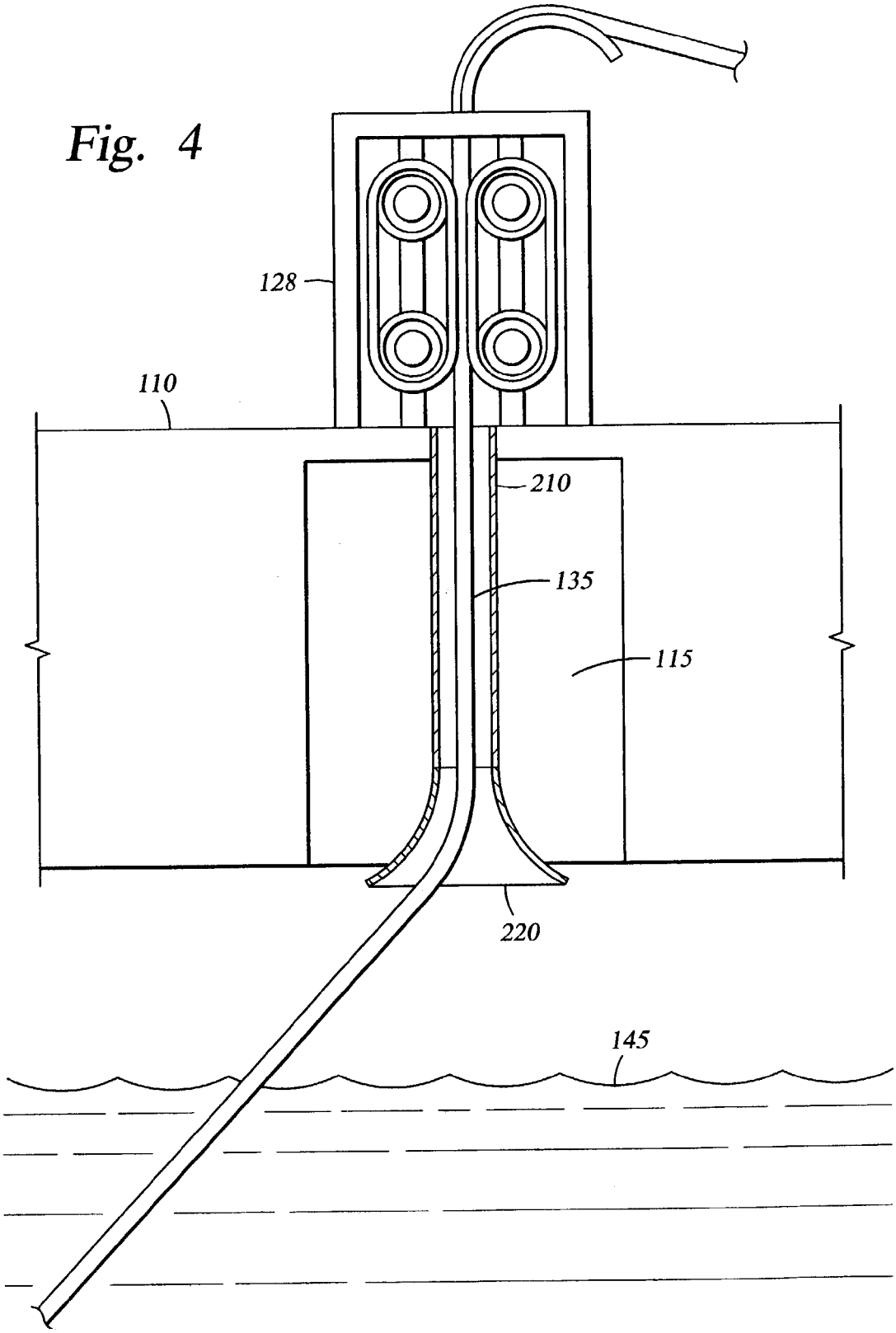
FIG. 4 is an enlarged schematic view of the drilling operation of FIG. 2, depicting the coiled tubing drill string extending through a moonpool in the floating vessel.

The water currents 230 also cause a bending effect on the drill string 135. If the coiled tubing drill string 135 bends too sharply, then it will kink or collapse. Thus, a minimum bending radius must be maintained to prevent the drill string 135 from buckling or kinking, which would occur prior to the drill string 135 yielding. To counteract the tendency for the lightweight drill string 135 to kink below the coiled tubing injector 128 and at the point of entry at the seafloor 150, various devices are preferably provided as shown in FIGS. 2 and 4. In particular, a bend limiter, such as a bellmouth 185, is provided subsea to prevent the drill string 135 from bending beyond its allowable minimum bend radius as it enters the structural casing 170. At the floating vessel 110, a variety of means may be used to maintain the minimum bend radius of the drill string 135. For example, a rigid extension 210 and a bend limiter, such as a bellmouth 220, may be provided to restrict the drill string 135 from bending beyond its allowable minimum bend radius as it exits the injector 128.

Figure 4A:
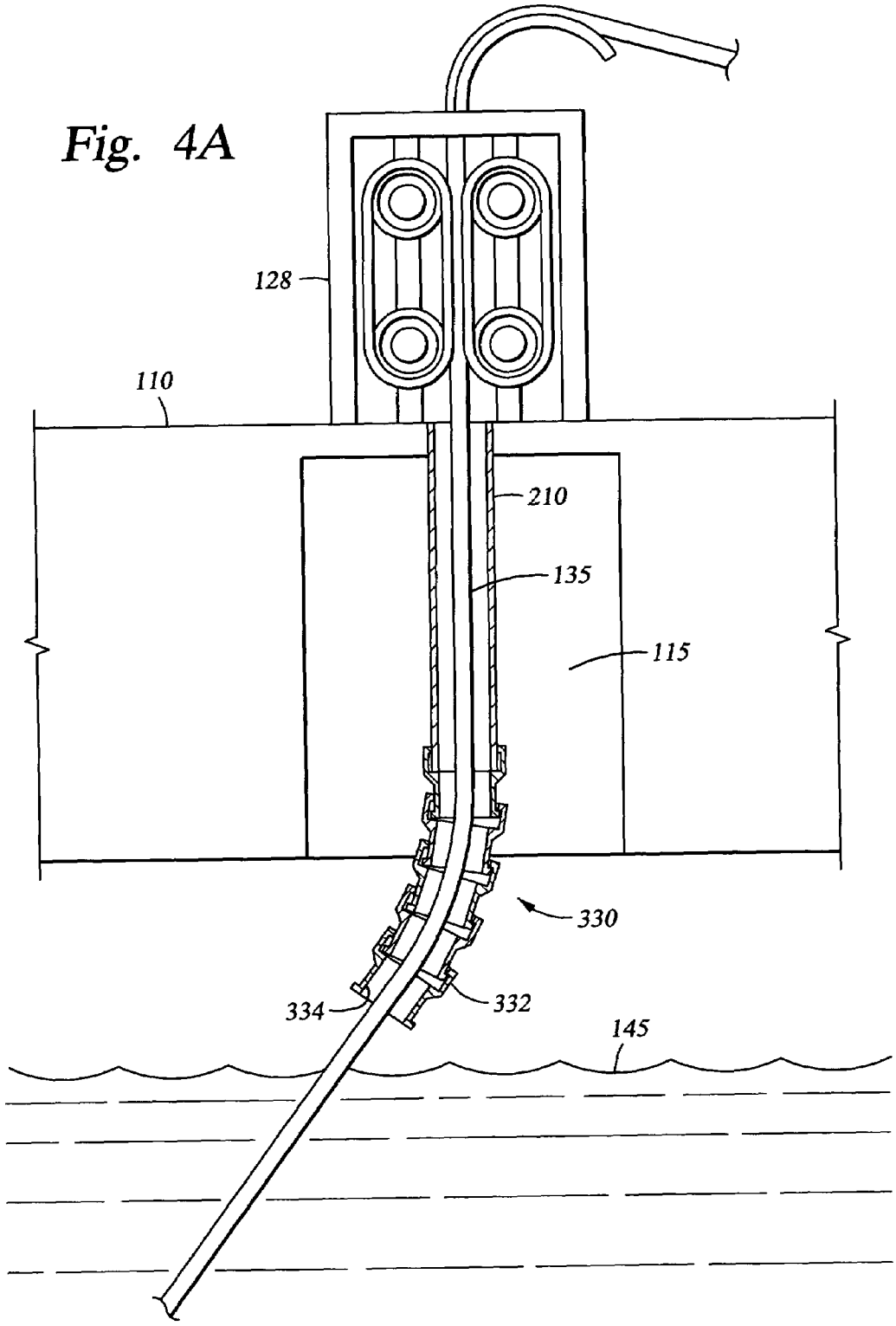
FIG. 4A is an enlarged schematic view of the drilling operation of FIG. 4, depicting a segmented bend restricter with a tube therethrough.
Figure 4B:
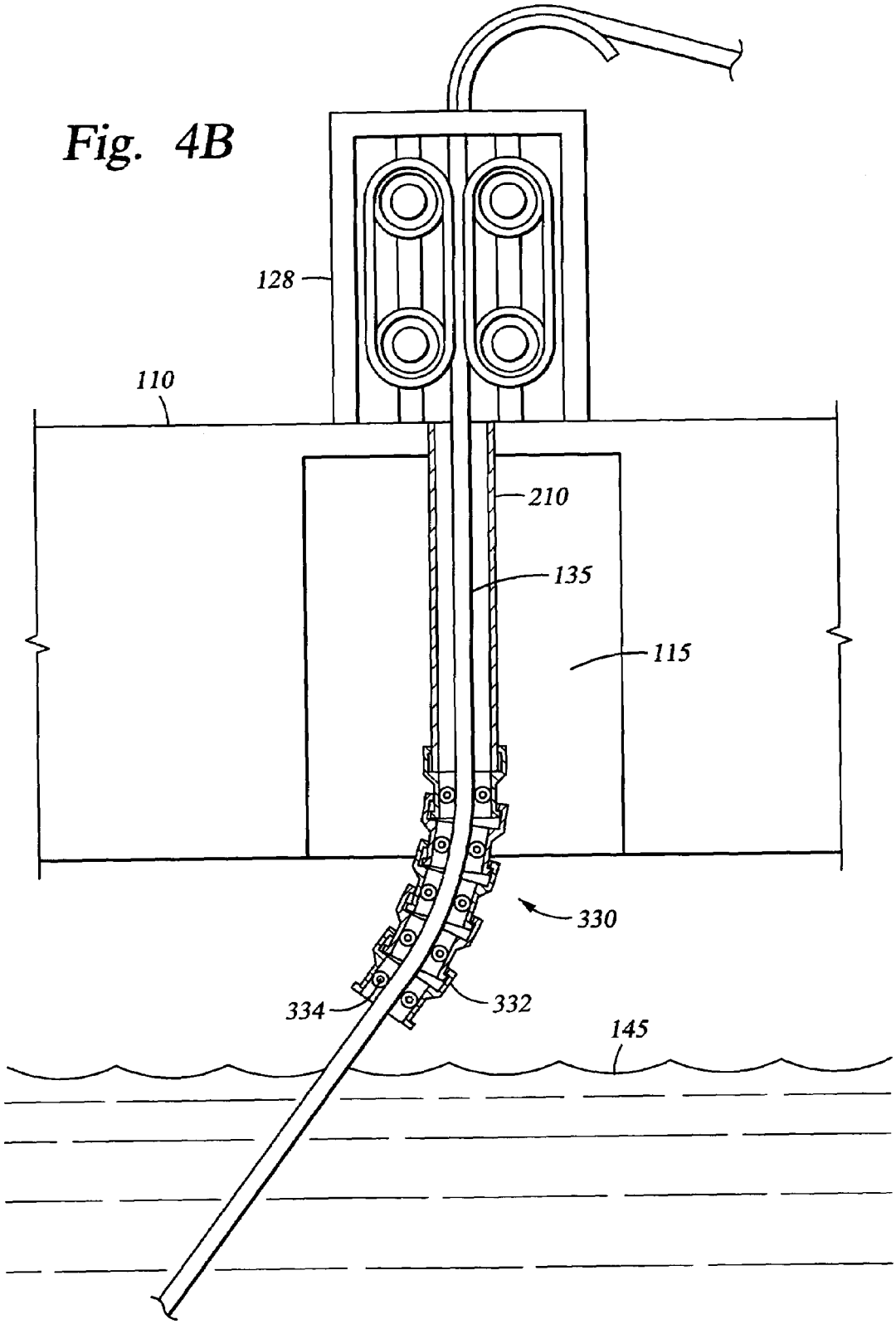
FIG. 4B is an enlarged schematic view of the drilling operation of FIG. 4, depicting a segmented bend restricter with rollers.

Referring to FIG. 4, a moonpool 115 is disposed through the floating vessel 110. The injector 128 is disposed above the inlet to the moonpool 115, and the coiled tubing drill string 135 extends downwardly from the injector 128 through the moonpool 115. At some point near the water surface 145, the lightweight drill string 135 passes through the bellmouth 220, which may be internally coated with a low friction coating to reduce the sliding friction on the drill string 135 as it is raised and lowered through the bellmouth 200. In another embodiment, the bellmouth 220 may be replaced with a bend restrictor 330 shown in FIG. 4A, which is preferably a segmented device. One type of bend restrictor 330 comprises segments 332 of interlocking half rings. Each segment of the bend restrictor is designed to bend only to a predetermined angle. Each segment will lock up, i.e. prevent further bending, when the bend in the segment reaches a predetermined angle, such that the bend restrictor establishes a minimum bend radius. The coiled tubing drill string 135 extends through the bend restrictor 330, which is preferably lined internally with a flexible tube 334 to provide a smooth, low friction surface against which the coiled tubing 135 slides. Accordingly, the half-ring segments of the bend restrictor 330 fit around the flexible tube 334 to establish a minimum bend radius of the flexible tube 334 through which the drill string 135 extends. Another type of bend restrictor is a segmented sleeve 340 shown in FIG. 4B with rollers 342 mounted internally of each segment 344. The drill string 135 extends through the sleeve 340 and is engaged by the rollers 342. Each segment 344 of the sleeve 340 is designed to bend only to a predetermined angle, thereby establishing a minimum bend radius for the drill string 135.

Figure 4C:
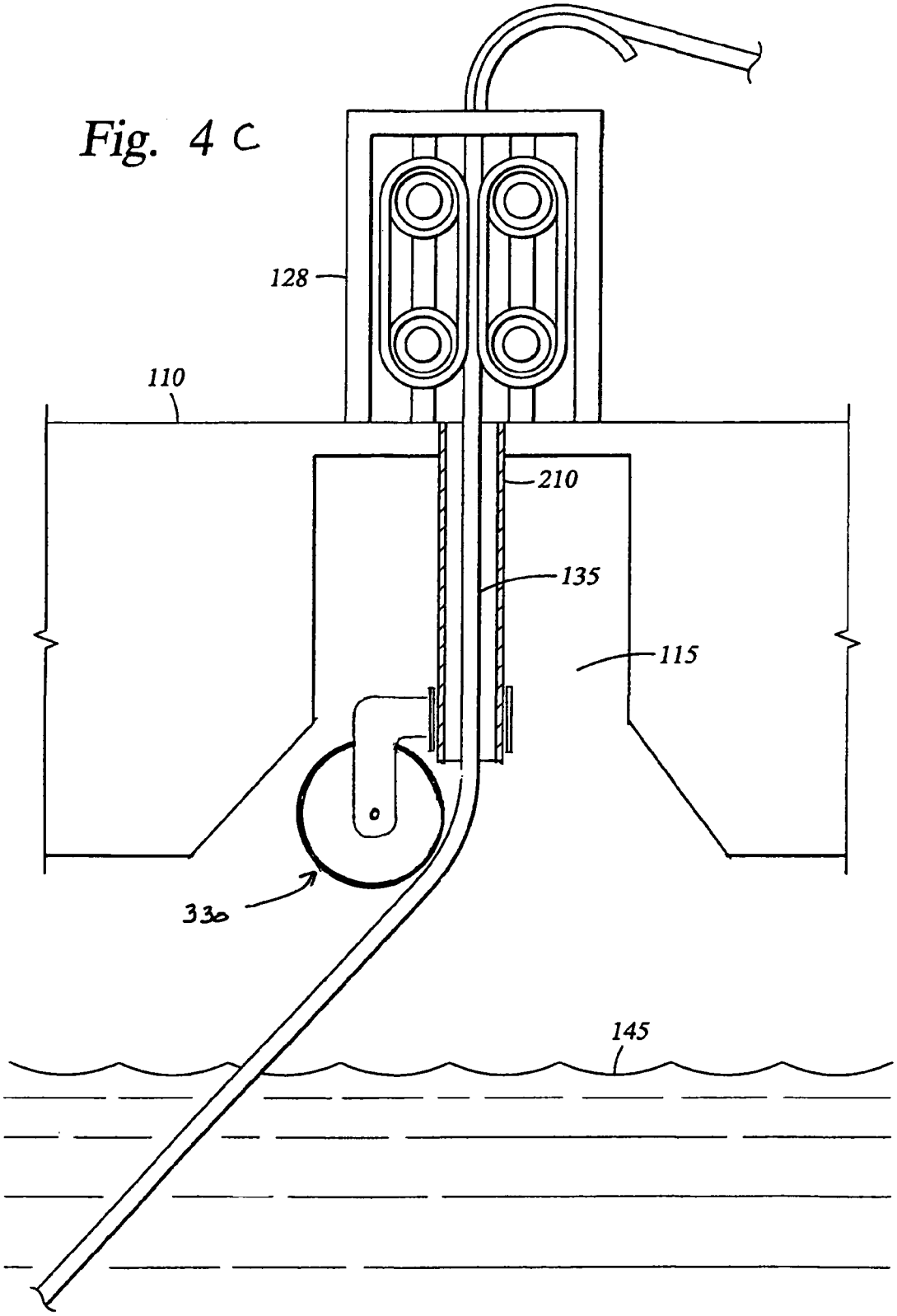
FIG. 4C is an enlarged schematic view of the drilling operation of FIG. 4, depicting a sheave engaging the coiled tubing drill string.

The bellmouth 220 or bend restrictor 330, 340 must extend into the moonpool 115 a pre-determined distance to avoid engagement between the drill string 135 and the floating platform 100 adjacent the lower end of the moonpool 115. Thus, a rigid extension or tubular 210 extends from the bottom of the injector 128 to a point within the moonpool 115 such that when the bellmouth 220 or bend restrictor is mounted below the extension 210, the lightweight drill string 135 will extend below the moonpool 115 and will not engage the vessel 110 as it extends through the water surface 145 and downwardly to the seafloor 150. Although conventional bend limiters have been depicted and described, one of ordinary skill in the art will readily appreciate that various other devices may be provided instead of bend limiters to maintain a minimum bend radius. For example, the drill string 135 could extend around a pivotal sheave 330 shown in FIG. 4C.

Figure 4D:
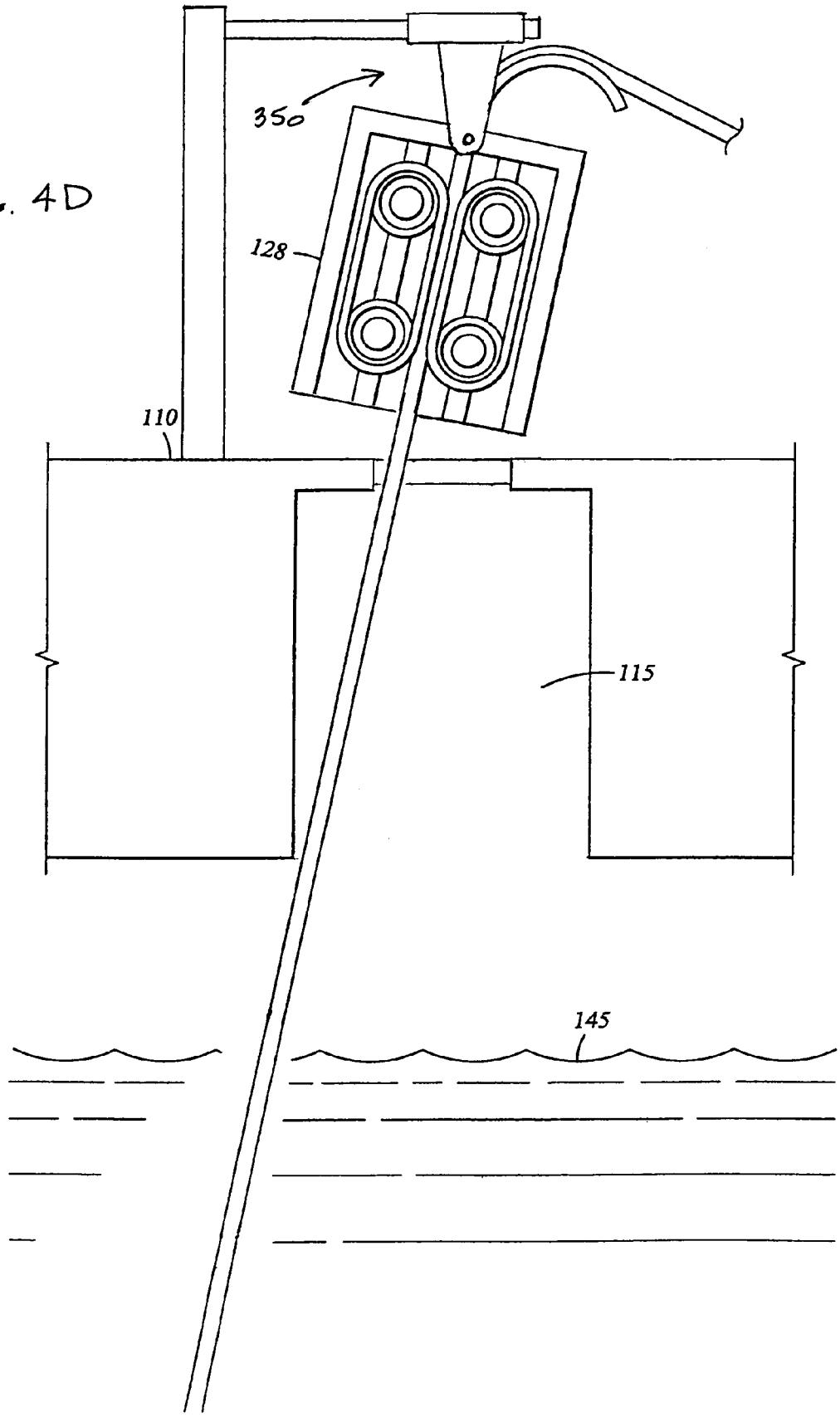
FIG. 4D is an enlarged schematic view of the drilling operation of FIG. 4, depicting a pivotal injector.

Alternatively, due to the use of a lightweight drill string 135, it would be possible to maintain a minimum bend radius of the drill string 135 by providing pivotal support means 350 shown in FIG. 4D for the coiled tubing injector 128 instead of bend limiters and other such devices. The pivotal support means 350 would enable the injector 128 itself to pivot at an angle from vertical as necessary to prevent overbending of the drill string 135. For example, the pivotal support means could comprise a gimbaled table flexibly attached to the platform 100, such as by non-linear springs. One such gimbaled table is depicted and described in U.S. Pat. No. 6,431,284 to Finn et al., hereby incorporated herein by reference. However, the gimbaled table exemplifies only one possible pivotal support means, and is not intended to be limiting. As one of ordinary skill in the art will understand, a number of alternate means may be utilized for pivotally supporting the injector 128. Accordingly, at the platform 100, a variety of means may be employed to prevent overbending of the drill string 135.

Figure 2A:
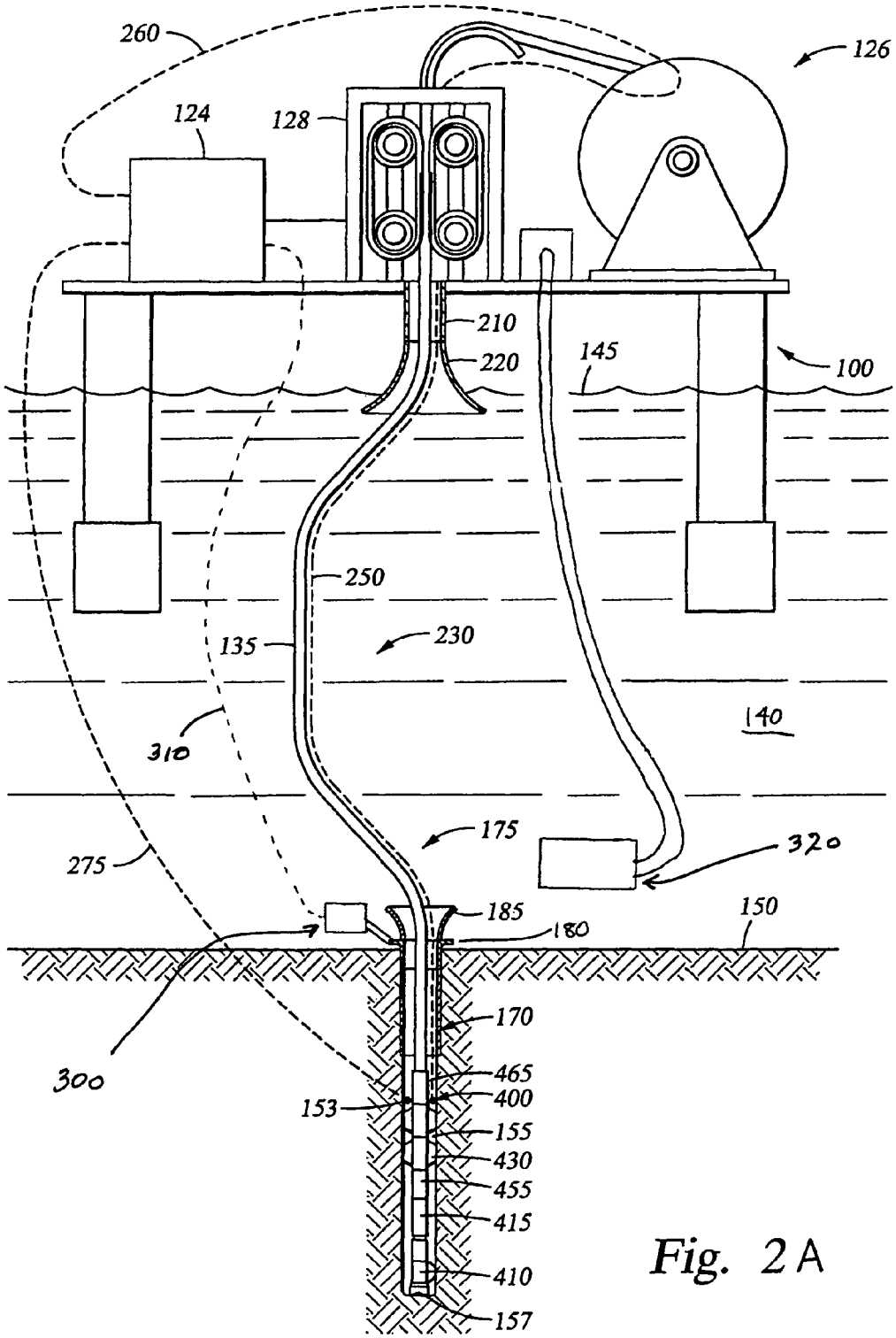
FIG. 2A is a schematic elevational view of the drilling system of FIG. 2 depicting an inclination measurement means and a remotely operated vehicle.

At the seafloor 150, it is preferable to include an inclination measurement means 300 shown in FIG. 2A to monitor the angle from vertical that the drill string 135 enters at the structural casing 170, to ensure that the drill string 135 is not kinking. The inclination measurement means 300 would preferably measure the angle at the bellmouth 185. However, a bend restrictor may also be added subsea such that a gauge or sensor could measure the angle of the bend restrictor. Alternatively, a bend restrictor could be used instead of a bellmouth 185 at the seafloor 150. An inclination sensor may be mounted at the upper end of the bend restrictor to measure the angle of the bend restrictor segments corresponding to the angle of the drill string 135 exiting the bend restrictor. Another inclination measurement means 300 may include photocells arranged around the mouth or the opening of the bellmouth 185. Still another inclination measurement means 300 might include an acoustic device to determine the angle of the drill string 135. It also may be possible to determine the direction that the drill string 135 extends from the bellmouth 185. Regardless of how the angle of the drill string 135 is measured, the data is transmitted at 310 to the floating platform 100. Then the injector 128 modifies the tension in the drill string 135 to change the angle of entry, or the platform 100 may be moved to change the angle of entry, if necessary. Thus, the bend radius or angle of entry of the drill string 135 is monitored such that real-time adjustments can be made to correct any problems detected.

Once the borehole 155 has been drilled, the drill string 135 and BHA 400 are tripped to the floating platform 100, and the remainder of the drilling operation is conducted in a conventional manner. Thus, the conductor casing is set and cemented in the borehole 155, and a subsea blowout preventer is installed. Then a riser is run down for the drilling of subsequent boreholes and to provide a means for taking returns to the floating platform 100.

However, in preferred embodiments, the remainder of the drilling operation is conducted utilizing the same drill string 135 and BHA 400 as used during riserless drilling, and preferably slimhole drilling is performed. Accordingly, because the preferred embodiments comprise using a lightweight drill string 135 and structural casing 170 that are preferably smaller diameter components, the same lightweight drill string 135 can be used with riser pipe and subsequent casing strings that are also preferably smaller diameter components, further reducing the size requirements of the floating platform 100. If the riser pipe is a high-pressure riser, a surface BOP at the platform may be utilized instead of utilizing a subsea BOP stack at the seafloor.

Accordingly, the preferred embodiments of the present invention provide improved methods and apparatus for conducting drilling operations from a bottom-founded or floating platform using a lightweight drill string in any water depth, and especially for conducting drilling operations in deep or ultra-deep water from a floating platform 100. In particular, a lightweight and preferably continuous drill string 135 is utilized for riserless drilling such that the required size and capacity of the platform is significantly reduced. The lightweight drill string is laterally constrained at each end, while also being axially controlled, and the drill string is unsupported by a riser as it extends through the water during drilling. The tension in the drill string is monitored, preferably via sensors in the BHA, and the drill string tension is adjusted at the platform. In preferred embodiments, the same lightweight drill string and BHA are used for the entire drilling operation, thereby enabling the use of smaller diameter riser pipe and casings, such as structural casing 170, to reduce the required size and capacity of the platform. As an example, these efficiencies are expected to reduce the live load requirement of the floating vessel by 50 percent or more when conducting drilling operations in 10,000 feet of water.

While preferred embodiments of this invention have been shown and described, modifications thereof can be made by one skilled in the art without departing from the spirit or teaching of this invention. For example, the present invention is not limited to drilling in deep water from a floating platform, and it is equally applicable to riserless drilling with a lightweight drill string from a bottom-founded platform in shallow water. Further, the dimensions provided are exemplary only and not limiting, such that the present invention is not limited to drilling slim boreholes, and it is equally applicable to riserless drilling for any size borehole and any size conductor casing. As another example, lightweight jointed drill pipe may be utilized instead of coiled tubing to make up the drill string. Thus, the embodiments described herein are exemplary only and are not limiting. Many variations and modifications of the methods and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A system for riserless drilling of a subsea borehole from a platform and through a subsea wellhead and into a cased borehole, the system comprising:

a lightweight drill string suspending a bottomhole assembly and extending from said platform downwardly through a depth of water, through the subsea wellhead and into the cased borehole, said lightweight drill string including a non-jointed, continuous tubing made of a lightweight metal or a lightweight composite material;

a first limiter disposed on the platform and limiting the range of bending motion of said drill string adjacent the platform as the drill string passes through the first limiter during drilling;

a second limiter having a bellmouth disposed on the wellhead limiting the range of bending motion of said drill string adjacent the cased borehole as the drill string passes through the second limiter during drilling; and wherein said segmented bend restrictor includes a flexible lining disposed therethrough.

2. A system for riserless drilling of a subsea borehole from a platform and through a subsea wellhead and into a cased borehole, the system comprising:

a lightweight drill string suspending a bottomhole assembly and extending from said platform downwardly through a depth of water, through the subsea wellhead and into the cased borehole;

a first limiter disposed on the platform and limiting the range of bending motion of said drill string adjacent the platform as the drill string passes through the first limiter during drilling;

a second limiter having a bellmouth disposed on the wellhead limiting the range of bending motion of said drill string adjacent the cased borehole as the drill string passes through the second limiter during drilling; and wherein said first limiter is a sheave limiting the range of bending motion of said drill string adjacent the platform.

3. A system for riserless drilling of a subsea borehole from a platform and through a subsea wellhead and into a cased borehole, the system comprising:

a lightweight drill string suspending a bottomhole assembly and extending from said platform downwardly through a depth of water, through the subsea wellhead and into the cased borehole;

a first limiter disposed on the platform and limiting the range of bending motion of said drill string adjacent the platform as the drill string passes through the first limiter during drilling;

a second limiter disposed on the wellhead limiting the range of motion of said drill string adjacent the cased borehole as the drill string passes through the second limiter during drilling; and wherein said first limiter is a pivotal support means for an injector suspending the drill string.

4. A system for riserless drilling of a subsea borehole from a platform and through a subsea wellhead and into a cased borehole, the system comprising:

a lightweight drill string suspending a bottomhole assembly and extending from said platform downwardly through a depth of water, through the subsea wellhead and into the cased borehole;

a first limiter disposed on the platform and limiting the range of bending motion of said drill string adjacent the platform as the drill string passes through the first limiter during drilling;

a second limiter disposed on the wellhead limiting the range of motion of said drill string adjacent the cased borehole as the drill string passes through the second limiter during drilling; and wherein said second limiter is a segmented bend restrictor having a flexible lining disposed therethrough.

5. A system for riserless drilling of a subsea borehole from a platform and though a cased borehole, the system comprising:

a lightweight drill string suspending a bottomhole assembly and extending from said platform downwardly through a depth of water and into said cased borehole;

a first limiter limiting the range of motion of said drill string adjacent said platform;

a second limiter limiting the range of motion of said drill string adjacent said cased borehole; and an inclination measurement means for measuring the entry angle of said drill string adjacent said cased borehole.

6. A method of drilling a subsea borehole from a platform and through a subsea wellhead and cased borehole, the method comprising:

lowering a bottomhole assembly suspended on a lightweight drill string from the platform through a depth of water, the lightweight drill string including a non-jointed, continuous tubing made of a lightweight metal or a lightweight composite material;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

counteracting an upward force on the bottomhole assembly to maintain the bottomhole assembly in the cased borehole;

drilling the subsea borehole; and wherein limiting the bend radius of the drill string adjacent the platform comprises passing the drill string through a bellmouth and a rigid extension, wherein the bellmouth is mounted on the rigid extension.

7. A method of drilling a subsea borehole from a platform and through a subsea wellhead and cased borehole, the method comprising:

lowering a bottomhole assembly suspended on a lightweight drill string from the platform through a depth of water, the lightweight drill string including a non-jointed, continuous tubing made of a lightweight metal or a lightweight composite material;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

counteracting an upward force on the bottomhole assembly using a maintenance means on the bottomhole assembly to maintain the bottomhole assembly in the cased borehole;

drilling the subsea borehole; and wherein limiting the bend radius of the drill string adjacent the platform comprises passing the drill string through a segmented bend restrictor having a flexible lining disposed therethrough.

8. A method of drilling a subsea borehole from a platform and through a subsea wellhead and cased borehole, the method comprising:

lowering a bottomhole assembly suspended on a lightweight drill string from the platform through a depth of water;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

maintaining the bottomhole assembly in the cased borehole;

drilling the subsea borehole; and wherein limiting the bend radius of the drill string adjacent the platform comprises passing the drill string around a sheave.

9. A method of drilling a subsea borehole from a platform and through a subsea wellhead and cased borehole, the method comprising:

lowering a bottomhole assembly suspended on a lightweight drill string from the platform through a depth of water, the lightweight drill string including a non-jointed, continuous tubing made of a lightweight metal or a lightweight composite material;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

counteracting an upward force on the bottomhole assembly using a maintenance means on the bottomhole assembly to maintain the bottomhole assembly in the cased borehole;

drilling the subsea borehole; and wherein limiting the bend radius of the drill string adjacent the platform comprises pivotally supporting an injector that suspends the drill string.

10. A method of drilling a subsea borehole from a platform and through a subsea wellhead and cased borehole, the method comprising:

lowering a bottomhole assembly suspended on a lightweight drill string from the platform through a depth of water, the lightweight drill string including a non-jointed, continuous tubing made of a lightweight metal or a lightweight composite material;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

counteracting an upward force on the bottomhole assembly to maintain the bottomhole assembly in the cased borehole;

drilling the subsea borehole; and wherein limiting the bend radius of the drill string adjacent the cased borehole comprises passing the drill string through a bellmouth.

11. A method of drilling a subsea borehole from a platform and through a subsea wellhead and cased borehole, the method comprising:

lowering a bottomhole assembly suspended on a lightweight drill string from the platform through a depth of water, the lightweight drill string including a non-jointed, continuous tubing made of a lightweight metal or a lightweight composite material;

limiting the bend radius of the drill string adjacent the platform as the lightweight drill string and bottomhole assembly are lowered;

guiding the bottomhole assembly into the cased borehole;

limiting the bend radius of the drill string adjacent the subsea wellhead as the lightweight drill string and bottomhole assembly are lowered;

counteracting an upward force on the bottomhole assembly to maintain the bottomhole assembly in the cased borehole;

drilling the subsea borehole; and wherein the platform is a floating platform and the bend radius of the drill string is limited below the floating platform and adjacent the platform.

12. A method of drilling a subsea borehole from a platform and through a based borehole, the method comprising:

lowering a bottomhole assembly suspended on a lightweight drill string from the platform through a depth of water;

limiting the bend radius of the drill string adjacent the platform;

guiding the bottomhole assembly into the cased borehole;

limiting the bend radius of the drill string adjacent the cased borehole;

maintaining the bottomhole assembly in the cased borehole; and drilling the subsea borehole; and wherein the lightweight drill string is composite coiled tubing.

13. A method of drilling a subsea borehole from a platform and through a based borehole, the method comprising:

lowering a bottomhole assembly suspended on a lightweight drill string from the platform through a depth of water;

limiting the bend radius of the drill string adjacent the platform;

guiding the bottomhole assembly into the cased borehole;

limiting the bend radius of the drill string adjacent the cased borehole;

maintaining the bottomhole assembly in the cased borehole; and drilling the subsea borehole; and guiding the bottomhole assembly into the cased borehole comprises the use of remotely operated vehicles.

14. A method of drilling a subsea borehole from a platform and through a cased borehole, the method comprising:

lowering a bottomhole assembly suspended on a lightweight drill string from the platform through a depth of water;

limiting the bend radius of the drill string adjacent the platform;

guiding the bottomhole assembly into the cased borehole;

limiting the bend radius of the drill string adjacent the cased borehole;

maintaining the bottomhole assembly in the cased borehole; and drilling the subsea borehole;

measuring an entry angle of the drill string adjacent the cased borehole; and adjusting the platform position in response to the entry angle measurement.

15. A method of drilling a subsea borehole from a platform and through a cased borehole, the method comprising:

lowering a bottomhole assembly suspended on a lightweight drill string from the platform through a depth of water;

limiting the bend radius of the drill string adjacent the platform;

guiding the bottomhole assembly into the cased borehole;

limiting the bend radius of the drill string adjacent the cased borehole;

maintaining the bottomhole assembly in the cased borehole; and drilling the subsea borehole;

measuring an entry angle of the drill string adjacent the cased borehole; and adjusting the drill string tension in response to the entry angle measurement.

16. A system for drilling a subsea borehole from a platform and through a cased borehole, the system comprising:

an injector suspending a lightweight drill string;

maintenance means on a lower end of said lightweight drill string; and at least one tension sensor that measures tension in said lightweight drill string;

wherein said injector adjusts the tension in said lightweight drill string in response to the measured tension; and wherein said maintenance means comprises a tractor.

17. A system for drilling a subsea borehole from a platform and through a cased borehole, the system comprising:

an injector suspending a lightweight drill string;

maintenance means on a lower end of said lightweight drill string; and at least one tension sensor that measures tension in said lightweight drill string;

wherein said injector adjusts the tension in said lightweight drill string in response to the measured tension; and wherein said maintenance means comprises a weight.

18. A system for drilling a subsea borehole from a platform and through a cased borehole, the system comprising:

an injector suspending a lightweight drill string;

maintenance means on a lower end of said lightweight drill string; and at least one tension sensor that measures tension in said lightweight drill string;

wherein said injector adjusts the tension in said lightweight drill string in response to the measured tension; and wherein said injector further adjusts the weight on bit of a bottomhole assembly in response to the measured tension.

19. The system of claim 16 further comprising a compression sensor below said tractor that measures compression in a bottomhole assembly.

20. The system of claim 19 wherein said tractor further adjusts the weight on bit of the bottomhole assembly in response to the measured compression.

21. A system for riserless drilling of a subsea borehole from a floating platform having a moonpool and through a subsea wellhead and into a cased borehole, the system comprising:

a lightweight drill string suspending a bottomhole assembly and extending from said platform downwardly through a depth of water, through the subsea wellhead and into the cased borehole, said lightweight drill string including a non-jointed, continuous tubing made of a lightweight metal or a lightweight composite material;

a first limiter disposed on the platform and limiting the range of bending motion of said drill string adjacent the platform as the drill string passes through the first limiter during drilling;

a second limiter having a bellmouth disposed on the wellhead limiting the range of bending motion of said drill string adjacent the cased borehole as the drill string passes through the second limiter during drilling;

wherein said first limiter includes a rigid extension extending from the platform with a bellmouth attached to the extension, said bellmouth having a terminal end extending below the moonpool and wherein said lightweight drill string passes through the extension and bellmouth;

wherein said first limiter is a segmented bend restrictor disposed on the platform; and wherein said segmented bend restrictor comprises a plurality of interlocking segments.

* * * * *